US006352567B1

(12) United States Patent
Windisch et al.

(10) Patent No.: US 6,352,567 B1
(45) Date of Patent: Mar. 5, 2002

(54) NONWOVEN ABRASIVE ARTICLES AND METHODS

(75) Inventors: Laurie A. Windisch, Stillwater; Mary Beth Donovan, St. Paul; Loc X. Van, Woodbury, all of MN (US); Gary T. Stram, Prairie Du Chien, WI (US)

(73) Assignee: 3M Innovative Properties Company, Saint Paul, MO (US)

( * ) Notice: Subject to any disclaimer, the term of this patent is extended or adjusted under 35 U.S.C. 154(b) by 0 days.

(21) Appl. No.: 09/513,400

(22) Filed: Feb. 25, 2000

(51) Int. Cl.[7] ..... B24D 3/00; B24D 3/28; B24D 11/00

(52) U.S. Cl. ..... 51/298; 51/295; 51/294; 51/307; 51/309

(58) Field of Search ..... 51/295, 298, 307, 51/309, 299, 294, 293

(56) References Cited

U.S. PATENT DOCUMENTS

| | | | | |
|---|---|---|---|---|
| 2,958,593 A | | 11/1960 | Hoover et al. | 51/295 |
| 4,078,340 A | | 3/1978 | Klecker et al. | |
| 4,227,350 A | | 10/1980 | Fitzer | 51/295 |
| 4,314,827 A | | 2/1982 | Leitheiser et al. | 51/298 |
| 4,623,364 A | | 11/1986 | Cottringer et al. | 51/309 |
| 4,652,274 A | | 3/1987 | Boettcher et al. | 51/298 |
| 4,652,275 A | | 3/1987 | Bloecher et al. | 51/298 |
| 4,744,802 A | | 5/1988 | Schwabel | 51/309 |
| 4,770,671 A | | 9/1988 | Monroe et al. | 51/293 |
| 4,799,939 A | | 1/1989 | Bloecher et al. | 51/293 |
| 4,881,951 A | | 11/1989 | Wood et al. | 51/309 |
| 4,903,440 A | | 2/1990 | Larson et al. | 51/298 |
| 5,061,294 A | | 10/1991 | Harmer et al. | 51/295 |
| 5,137,542 A | | 8/1992 | Buchanan et al. | 51/295 |
| 5,203,884 A | | 4/1993 | Buchanan et al. | 51/295 |
| 5,236,472 A | | 8/1993 | Kirk et al. | 51/298 |
| 5,378,252 A | | 1/1995 | Follensbee | 51/298 |
| 5,482,756 A | | 1/1996 | Berger et al. | 428/36.2 |
| 5,591,239 A | * | 1/1997 | Larson et al. | 51/294 |
| 5,667,842 A | | 9/1997 | Larson et al. | 427/258 |
| 5,919,549 A | | 7/1999 | Van et al. | 428/141 |
| 6,017,831 A | | 1/2000 | Beardsley et al. | |

* cited by examiner

*Primary Examiner*—Michael Marcheschi
(74) *Attorney, Agent, or Firm*—Gregory D. Allen

(57) ABSTRACT

Described are abrasive articles comprising a nonwoven; a binder layer contacting the nonwoven and at least partially filling spaces between fibers of the nonwoven; first abrasive particles adhered to the binder layer; a slurry layer comprising a second binder and second abrasive particles, the slurry layer contacting the nonwoven and the first layer and at least partially filling spaces within the fibers of the nonwoven; and, methods of preparation of such articles.

48 Claims, 1 Drawing Sheet

NONWOVEN ABRASIVE ARTICLES AND METHODS

FIELD OF THE INVENTION

The invention relates to abrasive articles comprising or prepared from a nonwoven, binder, and abrasive particles. More specifically, the invention contemplates specific constructions of such abrasive articles that comprise a nonwoven, a layer having a binder and abrasive particles adhered or attached thereto, and another layer containing a binder and abrasive particles. The invention also relates to methods of making such nonwoven abrasive articles.

BACKGROUND

Abrasive articles are used industrially, commercially, and at a consumer level, to facilitate preparing other materials for use or processing. Exemplary uses of abrasive articles include treatment of a surface before priming or painting; cleaning a material to remove oxidation or debris; grinding or abrading a material for shaping; etc. In these applications, abrasive articles may be used to grind a surface or workpiece to a certain shape or form, to abrade a surface to clean or to facilitate bonding with a coating such as paint, or to provide a desired finish, especially a smooth finish.

Coated abrasive sheets of paper, cloth, and vulcanized fibers, and coated nonwoven materials, are examples of materials known to be useful in and as abrasive articles. These and other such materials can be formed into useful articles such as discs (which can sometimes be mounted onto a power tool), pads, sheets, wheels, sponges, and composites or combinations of these. The grinding or finishing properties of the abrasive article can be tailored to some degree to provide a desired level of aggressive removal of material, balanced with the need for a particular surface finish. These needs can also be balanced with the need for a relatively long useful life for the abrasive article. Typically, however, the useful life of an abrasive article is not suitably long, and therefore, there is a continuing need to provide new and improved abrasive articles that exhibit relatively longer useful lives, e.g., as compared to presently known and available abrasive products. It would be particularly desirable to identify such abrasive articles which also exhibit other advantageous properties, such as the ability to aggressively remove material, optionally balanced with an ability to provide a desirably smooth surface.

SUMMARY OF THE INVENTION

The present invention provides abrasive articles useful in surface conditioning operations and methods for the manufacture of such articles. The abrasive article can preferably have a useful combination of properties including long life, flexibility, and the ability (based in part on choices of materials used for its construction, e.g., abrasive particles, nonwoven, binders, etc.) to provide a desirably smooth finish balanced with desired aggressiveness in removing material.

In one aspect the invention provides a method for preparing an abrasive article. The method includes the following steps: applying a first binder precursor to a nonwoven; applying first abrasive particles to the first binder precursor; and applying a slurry to the first binder precursor and first abrasive particles, wherein the slurry comprises a second binder precursor and second abrasive particles, the second abrasive particles preferably having abrasive properties similar to those of the first abrasive particles. After application of the slurry, the first and second binder precursors can be exposed to conditions that will cause hardening of the first and second binder precursors. In a preferred embodiment of the method of the invention, during the time prior to application of the slurry, the applied first binder precursor is not exposed to conditions to cause hardening of the first binder precursor.

Another aspect of the invention relates to particularly preferred steps combined into an embodiment of the method. This preferred method includes the step of providing a nonwoven comprising fibers bonded to one another at their mutual contact points and having a first major surface, a second major surface, and a middle portion extending therebetween. A first binder precursor is applied to the nonwoven, preferably in an amount sufficient to provide a dry coating weight of about 200 grams per square meter or greater; the first binder precursor is preferably a phenolic, an aminoplast having pendant $\alpha,\beta$-unsaturated carbonyl groups, a urethane, an epoxy, an ethylenically unsaturated material, an acrylated isocyanurate, a urea-formaldehyde, an isocyanurate, an acrylated urethane, an acrylated epoxy, a bismaleimide, an epoxy having fluorine substituent groups, or a combination of these. First abrasive particles are applied to the first binder precursor. A slurry is applied to the first binder precursor and first abrasive particles, preferably in an amount to provide a dry add-on weight of about 200 grams per square meter or greater; the slurry comprises second abrasive particles preferably having abrasive properties similar to those of the first abrasive particles and a second binder precursor that includes an acrylate, a phenolic, a polyurethane, a polyurea, a styrene-butadiene rubber, a nitrile rubber, a polyisoprene, or a combination thereof. After application of the slurry, the first and second binder precursors are exposed to conditions to cause hardening of the binder precursors.

In another aspect, the invention relates to abrasive articles constructed of materials including a nonwoven; a binder layer contacting the nonwoven and at least partially filling spaces between fibers of the nonwoven; first abrasive particles adhered to the binder layer; and a slurry layer comprising a second binder and second abrasive particles preferably having abrasive properties similar to those of the first abrasive particles, the slurry contacting the nonwoven and at least partially filling spaces within the fibers of the nonwoven. The article can be manufactured and processed into various forms such as a disc, a pad, a belt, a wheel, or a sheet, etc., or combinations or composites thereof.

As used herein, certain terms will be understood to have the meanings as set forth herein. "Fiber" refers to a thread-like structure comprising any of the materials as described herein. The term "precursor" refers to a material such as a prebond precursor, a binder precursor, a size coat precursor, etc., that can be coated onto a nonwoven and hardened, e.g., to bond the fibers at their mutual contact points, or to adhere particles. Upon hardening of the precursor, the hardened material is referred to using the same general designation (e.g., first or second binder, size coat, etc.), but without being referred to as a "precursor".

BRIEF DESCRIPTION 0F THE DRAWINGS

DETAILED DESCRIPTION

The invention provides articles comprising at least a nonwoven, a binder, and abrasive particles. The invention further provides methods of preparing such articles.

Figure 1:
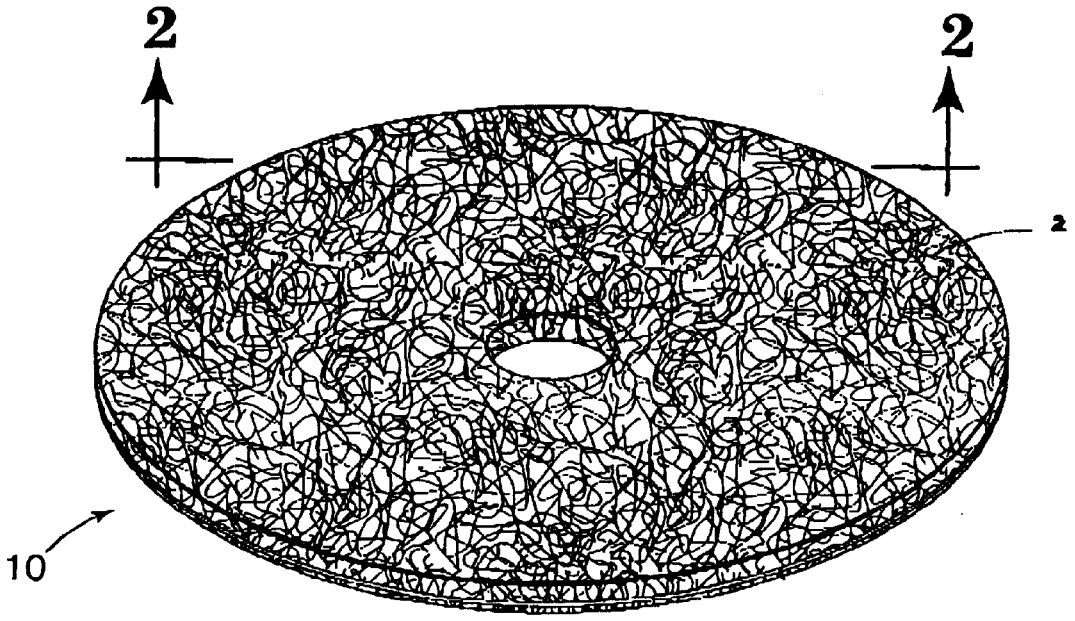
FIG. 1 is a perspective view of an abrasive disc of the invention.
Figure 2:
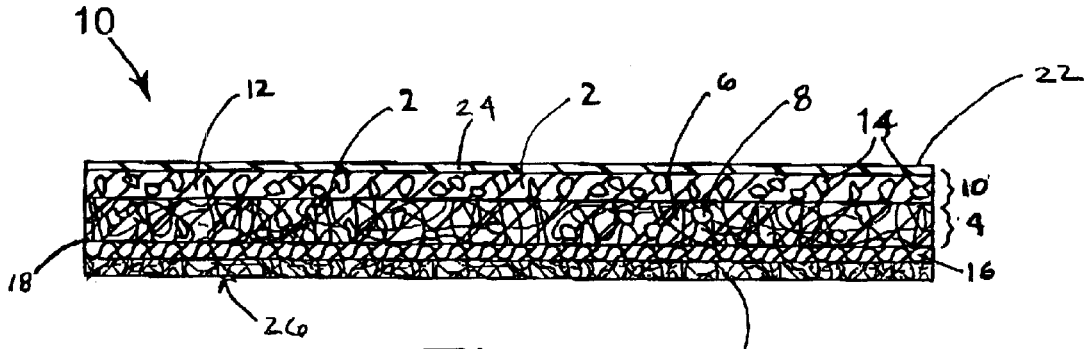
FIG. 2 is an enlarged side elevational view of the abrasive disc of FIG. 1.

Exemplary articles of the invention comprise a fibrous nonwoven material, a binder layer comprising a first binder contacting the nonwoven and at least partially filling space between fibers of the nonwoven, first abrasive particles adhered to the binder layer, and a slurry layer comprising a second binder and second abrasive particles. The binder layer and the slurry layer each contact the nonwoven, and each at least partially fill spaces within the fibers of the nonwoven. In preferred embodiments the binder layer contacts or is at least proximal to the slurry layer. An embodiment of the article is illustrated in FIGS. 1 and 2, which shows a disc article 10 constructed of a nonwoven 2, a binder layer 4 made of a first binder 6 and first abrasive particles 8, and a slurry layer 10 made of a second binder 12 and second abrasive particles 14. Each of the binder layer and the slurry layer contact the nonwoven and at least partially fill space between fibers of the nonwoven. The slurry in its hardened form can also be present on surfaces of fibers at a surface of the article. Also, in the embodiment shown in FIG. 2, the binder layer 4 contacts the slurry layer 10. As shown in the figure, the article has a size coat 24, and a surface 22 used as the working surface of the article 10. A second surface of the nonwoven is positioned adjacent a reinforcing layer 16. A middle portion of the nonwoven extends between the working surface and the surface 26 of the nonwoven layer 2.

The slurry layer exhibits abrasive properties. It can be important in abrasive articles that the abrasive article exhibit similar abrasive properties throughout its useful lifetime, i.e., the abrasive article exhibit the same or similar cut and finish properties when it is new, compared to when it is at the end or nearly at the end of its useful life. Because of this, with respect to the slurry layer and the binder layer (including the first abrasive particles) of the present invention, it can be preferable that these different layers exhibit similar abrasive properties, e.g., as measured by standard testing methods relating to cutting ability and surface finish quality.

Nonwovens useful in the articles of the invention include fibrous materials such as those that that are known and used in the arts of nonwovens and abrasives. The nonwoven can preferably be in the form of a lofty, open, low-density, fibrous material, preferably having two opposing major surfaces and a middle portion extending therebetween, e.g., in the form of a web.

The fiber of the nonwoven can preferably be compatible with adhering binders and abrasive particles, while also being processable in combination with other components of the article, e.g., binder precursors, hardened binders, and abrasive materials, most preferably being able to withstand temperatures at which such binder precursors and other materials are applied and processed. Also, the fiber can be chosen to affect properties of the abrasive article such as flexibility, elasticity, durability or longevity, abrasiveness, and finishing properties.

Examples of suitable fibers include natural fibers, synthetic fibers, and mixtures thereof. Synthetic fibers are preferred, including those made of polyester (e.g., polyethylene terephthalate), nylon (e.g., hexamethylene adipamide, polycaprolactum), polypropylene, acrylic (formed from a polymer of acrylonitrile), rayon, cellulose acetate, polyvinylidene chloride-vinyl chloride copolymers, vinyl chloride-acrylonitrile copolymers, and so forth. Suitable natural fibers include cotton, wool, jute, and hemp. The fiber may be of virgin materials or of recycled or waste materials reclaimed from garment cuttings, carpet manufacturing, fiber manufacturing, or textile processing, for example. The fiber can be homogenous or a composite, such as a bicomponent fiber (e.g., a co-spun sheath-core fiber). It is also within the scope of the invention to provide an article comprising different fibers in different portions of the nonwoven (e.g., at a first major surface, a second major surface, and within the middle portion therebetween). The fibers are preferably tensilized and crimped, but may also be continuous filaments such as those formed by an extrusion process, e.g., as described in U.S. Pat. No. 4,227,350 (Fitzer), incorporated herein by reference.

The nonwoven may be made by conventional air-laid, carded, stitch-bonded, spunbonded, wet laid, or melt blown procedures. One preferred nonwoven material is an air laid web, which can be prepared as described by in U.S. Pat. No. 2,958,593 (Hoover et al.), incorporated herein by reference. The nonwoven may be prepared in the form of a web, using commercially available air lay equipment such as that available under the trade designation RANDO WEBBER, commercially available from Rando Machine Company of Macedon, N.Y.

Nonwovens of the type described by Hoover et al., can preferably be constructed of fibers having a length in the range between about 20 and about 110 millimeters, preferably between about 40 and about 65 millimeters in length, and can have a fineness or linear density ranging from about 1.5 (1.7 dtex) to about 500 denier (555.6 dtex), more preferably from about 15 (16.7 dtex) to about 110 denier (122.2 dtex). Fibers of mixed denier can be used, e.g., to provide an abrasive article that upon use will result in a specifically preferred surface finish. Where a spunbond-type nonwoven is used, the filaments may be of substantially larger diameter, for example, up to 2 millimeters or more in diameter.

Useful nonwoven materials can typically have a weight per unit area of at least about 50 grams per square meter ($g/m^2$), preferably between 50 and 400 $g/m^2$, more preferably between 200 and 300 $g/m^2$, as measured prior to any coating, i.e., prior to application of any prebond or binder precursors. Lesser amounts of fiber in the nonwoven may provide articles which may be suitable in some applications, but articles with lower fiber weights may have somewhat shorter commercial work lives. The foregoing fiber weights typically will provide a nonwoven (before needling or impregnation) having a thickness from about 5 to about 200 millimeters, typically between 6 and 75 millimeters, and preferably between 10 and 30 millimeters.

The nonwoven can preferably be reinforced and consolidated by any of various methods known and understood in the art of nonwoven materials, including thermal or chemical bonding, hydroentanglement, etc. A preferred method of reinforcing is by needle-tacking, a treatment which mechanically strengthens the nonwoven by passing barbed needles therethrough. The barbed needles push and pull fibers of the nonwoven through the nonwoven, so that after needle-tacking, individual fibers of the nonwoven are oriented substantially in the thickness direction of the nonwoven. The amount or degree of needle-tacking may, for example, include the use of from about 8 to about 20 needle penetrations per square centimeter of web surface when 15×18×25×3.5 RB, F20 6-32-5.5B/3B/2E/L90 needles (commercially available from Foster Needle Company, Manitowoc, Wis.) are used. Needle-tacking processes are well known in the art of nonwoven materials, and are readily accomplished by use of a conventional needle loom equipment commercially available, for example, from Dilo, Inc. of Charlotte, NC. or DOA, Linz, Austria.

In some embodiments the article can include a reinforcing layer affixed to the nonwoven, the reinforcing layer preferably comprising a dimensionally-stable, woven, fibrous material, e.g., a scrim. The reinforcing layer and its fibers should be capable of withstanding processing into an abrasive article as described herein, and is preferably stable at relevant processing conditions, e.g., temperatures at which binder precursors are applied and processed. The properties of the reinforcing layer can also influence physical properties of an abrasive article prepared therefrom, including stiffness, flexibility, durability, etc. The reinforcing layer can most preferably have a relatively open weave which may permit a degree of cooling when the article is in use. The reinforcing layer can preferably be a woven stretch-resistant fabric, and preferably has tensile strain in at least one direction of less than 5% stretch, preferably less than 2.5%, at tensile loadings up to 100 lb/in. Suitable reinforcing layer materials include thermobonded fabrics, knitted fabrics, stitch-bonded fabrics, and the like, and in particular can include fibers of nylon and/or polyester.

A reinforcing layer can be affixed to the nonwoven by methods that are useful or known in the art of nonwoven materials, using conventional materials such as adhesives and needle-tacking techniques. For example, in some embodiments of the invention, (e.g., where the web is to be incorporated into a machine driven abrasive article such as a belt or abrasive disc), a reinforcing layer can be contacted with a surface of the nonwoven material before needle-tacking. The nonwoven is needle-tacked while contacting the reinforcing layer, such that fibers of the nonwoven are pushed or pulled from one side of the reinforcing layer, through the reinforcing material, and out the other side. Needle-tacking thereby affixes the reinforcing layer to the nonwoven material. Although other methods for affixing the materials can be used (e.g., an adhesive), the needle-tacking operation is generally sufficient to secure the materials to one another. If a prebond (described below) is used with an article having a nonwoven material needle-tacked to a reinforcing layer, the prebond is preferably applied after the needle-tacking step.

FIG. 2 illustrates an exemplary construction of an abrasive article having a reinforcing layer. Article 10 includes reinforcing layer 16 affixed to nonwoven 2 by needle-tacking. In the figure, the fibers of nonwoven 2 have been pulled by needle-tacking from one side of reinforcing layer 16 (the "top" side, which is the side on which the nonwoven is initially contacted prior to needle-tacking) to the other side (the "bottom" side), causing nonwoven 2 to become affixed to the reinforcing layer 16. The degree to which fibers of the nonwoven are pulled from the top side of the reinforcing layer to the bottom side can be any desired amount. This degree of needle-tacking can be measured as the "thickness ratio", which is defined as the thickness of nonwoven material on the top side of the reinforcing layer per the total thickness of nonwoven material. An example of a useful degree of needle-tacking for producing abrasive disc articles is a thickness ratio of about 60%, i.e., wherein about 60% of the thickness of the nonwoven material is located on the top side of the reinforcing layer, and about 40% of the thickness of the nonwoven material has been pulled through the reinforcing layer to the other side.

After affixing a reinforcing layer to a nonwoven by use of needle-tacking, an adhesive or polymeric material may be applied to the exposed surface of the reinforcing layer to more permanently affix the nonwoven to the reinforcing layer. This can be accomplished, e.g., in the manner described in U.S. Pat. No. 5,482,756, incorporated herein by reference.

The fibers of the nonwoven can be bonded to one another, if desired, at their mutual contact points. Various methods and materials exist and are known for use to produce such bonding, including thermal techniques and chemical techniques. One way to accomplish bonding of the fibers is chemical bonding, which can include application to the nonwoven of a chemical bonding agent of the type sometimes referred to as a "prebond resin", or referred to herein as a "prebond precursor". The prebond precursor can be applied to the nonwoven in a manner allowing the prebond precursor to accumulate at mutual contact points of the fibers. The prebond precursor is thereafter processed to be hardened, which can be accomplished by various known methods, with the particular method used depending to a large extent on the chemistry of the precursor. In hardening, the precursor is solidified, i.e., cured, crosslinked, solidified by evaporation or evolution of solvent, cooled to a solid, or otherwise, by exposure to appropriate conditions. Preferably, the prebond precursor comprises a monomeric or polymeric material which may be thermoplastic, thermosetting, or crosslinkable, such as a curable, thermoplastic, or thermosetting adhesive.

A variety of materials are known and commonly used as prebond precursors. Preferred materials include those that can be hardened to form a tough, flexible, rubbery, or elastomeric prebond material. Examples include polyurethanes, polyureas, styrene-butadiene rubbers, nitrile rubbers, latex-modified phenolics, and polyisoprene. Latex-modified phenolics are particularly preferred, and preferred polyurethanes include those resulting from the reaction of an isocyanate with a polyol.

Those skilled in the production of nonwoven abrasive articles will appreciate that the selection, amount, method of application, and chemical composition of prebond precursor used for a particular embodiment of the invention can depend on a variety of factors including the fiber weight in the nonwoven, fiber density, fiber type, and the contemplated end use and desired properties of the finished abrasive article. In general, the prebond precursor can be applied to a nonwoven as a relatively light coating, for example in a coating weight range between about 200 and 600 grams per square meter (dry add-on weight), preferably at least about 300 $g/m^2$.

The prebond precursor may be applied to the nonwoven in any known manner in order to bond fibers of a nonwoven to one another. A preferred method for the application of a prebond precursor is by roll coating, e.g., by use of a conventional two roll coater. Still, other methods may also be useful. After coating, the prebond precursor can be hardened to provide a prebond coated onto the nonwoven (i.e., a prebonded nonwoven). Hardening can occur by a method generally depending on the chemical identity of the prebond precursor and its mechanism for hardening. Examples of conditions that the prebond precursor can be exposed to to cause hardening include conditions known to cure, polymerize, crosslink, or otherwise harden or solidify a chemical composition, e.g., elevated temperature, ultraviolet or other radiation, cooling, etc. The prebonded nonwoven may be wound or otherwise packaged in a manner convenient for subsequent processing as described herein.

The abrasive article comprises a binder layer that includes a first binder adhered to the nonwoven and first abrasive particles contained therein or adhered thereto. The binder layer at least partially fills space between fibers of the nonwoven, and the fibers extend through the binder layer. If a reinforcing layer is provided, the binder layer preferably contacts the reinforcing layer and the nonwoven at the surface of the reinforcing layer. This is illustrated at FIG. 2, wherein binder layer 4 contacts and fills spaces of nonwoven 2, while binder layer 4 also contacts reinforcing layer 16 at surface 18 of reinforcing layer 16.

The first binder can be prepared from a binder precursor, which can be a coatable, hardenable material sometimes referred to or known as a "make coat". Materials suitable for use as binder precursors include those known in the art of nonwoven abrasive articles. Some are described, e.g., in U.S. Pat. No. 5,919,549, which is incorporated herein by reference. The binder precursor can typically be applied to the nonwoven as a flowable liquid capable of being hardened, i.e., cured, crosslinked, solidified by evaporation or evolution of solvent, cooled to a solid, or otherwise, to bond to fibers of the nonwoven and to abrasive particles. Preferably, the binder precursor comprises a monomeric or polymeric material which may be thermoplastic, thermosetting, or crosslinkable, such as a curable or thermosetting adhesive, and mixtures thereof. Upon hardening, the binder precursor forms a binder that bonds abrasive particles to the nonwoven.

Suitable crosslinkable binder precursors can include either condensation curable materials or addition polymerizable materials. Addition polymerizable materials can be ethylenically unsaturated monomers and/or oligomers. Examples of crosslinkable materials include phenolic resins, bismaleimide binders, vinyl ethers, aminoplasts having pendant alpha, beta unsaturated carbonyl groups, urethanes, epoxies, acrylates, acrylated isocyanurates, urea-formaldehydes, isocyanurates, acrylated urethanes, acrylated epoxies, or mixtures of any of the foregoing.

Phenolic materials can be preferred binder precursors because of their thermal properties, availability, cost, and ease of handling. Resole phenolics have a molar ratio of formaldehyde to phenol of greater than or equal to one, typically between 1.5:1.0 to 3.0:1.0. Novolac phenolics have a molar ratio of formaldehyde to phenol of less than 1.0:1.0. Examples of commercially available phenolics include those known by the trade names DUREZ and VARCUM from Occidental Chemicals Corp.; RESINOX from Monsanto; AROFENE from Ashland Chemical Co. and AROTAP from Ashland Chemical Co.

Some binder precursors include a phenolic mixed with a latex. Examples of such latexes include materials containing acrylonitrile butadiene, acrylics, butadiene, butadiene-styrene, and combinations thereof. These latexes are commercially available from a variety of different sources and include those available under the trade designations RHOPLEX and ACRYLSOL commercially available from Rohm and Haas Company, FLEXCRYL and VALTAC commercially available from Air Products & Chemicals Inc., SYNTHEMUL, TYCRYL, and TYLAC commercially available from Reichold Chemical Co., HYCAR and GOODRITE commercially available from B. F. Goodrich, CHEMIGUM commercially available from Goodyear Tire and Rubber Co., NEOCRYL commercially available from ICI, BUTAFON commercially available from BASF, and RES commercially available from Union Carbide.

Epoxies, i.e., materials having an oxirane group which can be polymerized by ring opening, can be useful within a binder precursor either as a monomeric compound or as medium or high molecular weight dimers, trimers, oligomers, prepolymers, polymers, etc. Epoxy compounds can vary greatly in the nature of their backbones and substituent groups. For example, the backbone may be of any type normally associated with an epoxy-functional polymer, and substituent groups thereon can be any group free of an active hydrogen atom that is reactive with an oxirane group at room temperature. Representative examples of acceptable substituent groups include halogens, ester groups, ether groups, sulfonate groups, siloxane groups, nitro groups and phosphate groups. Examples of some preferred epoxy materials include compositions containing a diglycidyl ether of bisphenol A, as well as materials that are commercially available under the trade designations EPON 828, EPON 1004, and EPON 1001F, available from Shell Chemical Co., DER-331, DER-332, and DER-334, available from Dow Chemical Co. Other suitable epoxies include glycidyl ethers of phenol formaldehyde novolac (e.g., DEN-431 and DEN-428 available from Dow Chemical Co.).

Examples of ethylenically unsaturated binder precursors include aminoplast monomer or oligomer having pendant alpha, beta-unsaturated carbonyl groups, ethylenically unsaturated monomers or oligomers, acrylated isocyanurate monomers, acrylated urethane oligomers, acrylated epoxy monomers or oligomers, ethylenically unsaturated monomers or diluents, acrylate dispersions or mixtures thereof.

Aminoplast binder precursors have at least one pendant alpha, beta-unsaturated carbonyl group per molecule or oligomer. These materials are further described in U.S. Pat. Nos. 4,903,440 and 5,236,472, both of which are incorporated herein by reference.

Ethylenically unsaturated monomers or oligomers may be monofunctional, difunctional, trifunctional, or tetrafunctional or of even higher functionality. The term "acrylate" as used herein is intended to include both acrylates and methacrylates. Ethylenically unsaturated binder precursors include monomeric, oligomeric, and polymeric compounds that contain atoms of carbon, hydrogen, and oxygen, and optionally, nitrogen and the halogens. Oxygen or nitrogen atoms or both are generally present in ether, ester, urethane, amide, or urea groups. Ethylenically unsaturated compounds preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of ethylenically unsaturated monomers include methyl methacrylate, ethyl methacrylate, styrene, divinylbenzene, hydroxy ethyl acrylate, hydroxy ethyl methacrylate, hydroxy propyl acrylate, hydroxy propyl methacrylate, hydroxy butyl acrylate, hydroxy butyl methacrylate, vinyl toluene, ethylene glycol diacrylate, polyethylene glycol diacrylate, ethylene glycol dimethacrylate, hexanediol diacrylate, triethylene glycol diacrylate, trimethylolpropane triacrylate, glycerol triacrylate, pentaerthryitol triacrylate, pentaerythritol trimethacrylate, pentaerythritol tetraacrylate and pentaerythritol tetramethacrylate. Other ethylenically unsaturated resins include monoallyl, polyallyl, and polymethallyl esters and amides of carboxylic acids, such as diallyl phthalate, diallyl adipate, and N,N-diallyladipamide. Still others include nitrogen-containing compounds such as tris(2-acryloxyethyl)isocyanurate, 1,3,5-tri(2-methyacryloxyethyl)-s-triazine, acrylamide, methylacrylamide, N-methylacrylamide, N,N-dimethylacrylamide, N-vinyl-pyrrolidone, and N-vinyl-piperidone.

Isocyanurate derivatives having at least one pendant acrylate group and isocyanate derivatives having at least one pendant acrylate group are further described in U.S. Pat. No. 4,652,274, incorporated by reference herein. A preferred isocyanurate material is a triacrylate of tris(hydroxy ethyl) isocyanurate.

Examples of acrylated urethanes include diacrylate esters of hydroxy terminated isocyanate extended polyesters or polyethers. Examples of commercially available acrylated urethanes include those available under the trade designations UVITHANE 782, available from Morton Chemical, and CMD 6600, CMD 8400, and CMD 8805, available from UCB Radcure Specialties. Examples of acrylated epoxies include diacrylate esters of epoxy resins, such as the diacrylate esters of bisphenol A epoxy resin. Examples of commercially available acrylated epoxies include those available under the trade designations CMD 3500, CMD 3600, and CMD 3700, available from UCB Radcure Specialties.

Examples of acrylated urethanes include diacrylate esters of hydroxy terminated NCO extended polyesters or polyethers. Examples of commercially available acrylated urethanes include UVITHANE 782, available from Morton Thiokol Chemical, and CMD 6600, CMD 8400, and CMD 8805, available from Radcure Specialties.

Examples of acrylated epoxies include diacrylate esters of epoxy resins such as the diacrylate esters of bisphenol A epoxy resin. Examples of commercially available acrylated epoxies include CMD 3500, CMD 3600, and CMD 3700, available from Radcure Specialties.

Examples of ethylenically unsaturated diluents or monomers can be found in U.S. Pat. Nos. 5,236,472 (Kirk et al.) and 5,667,842, the disclosures of which are incorporated herein by reference. In some instances these ethylenically unsaturated diluents are useful because they tend to be compatible with water.

Additional details concerning acrylate dispersions can be found in U.S. Pat. No. 5,378,252 (Follensbee), incorporated herein by reference.

Preferably, the binder precursor can be a phenolic or an epoxy (most preferably a phenolic) capable of forming a hard, brittle binder having a Knoop hardness of at least about 20 kg/mm$^2$. A particularly preferred phenolic is a resole formaldehyde/phenol condensate of a molar ratio 1.96:1 (formaldehyde:phenol) catalyzed by sodium hydroxide. Suitable such formaldehyde:phenol binder precursors can be 70% solids in water and may be obtained from commercial sources such as, for example, Neste, Inc. of Missasaqua, Ontario, Canada.

The binder precursor can preferably be applied to a nonwoven in an amount to provide a dry coating weight for the resulting binder of at least about 200 g/m$^2$, preferably at least about 400 g/m$^2$. The binder precursor is preferably applied to the nonwoven in a manner which causes the precursor to penetrate the nonwoven and, when hardened, to form a binder which at least partially fills space between fibers of the nonwoven.

Suitable methods for applying the binder precursor are known in the art of nonwoven abrasive articles, and include coating methods such as roll coating, spray coating, etc. A preferred coating method is by use of a metering roll, wherein a prebonded nonwoven is passed through a bath of liquid binder precursor, and then directed through a pair of driven nip rolls preset to provide sufficient pressure to the coated nonwoven so that the desired dry add-on weight for the make coat is achieved.

Referring to FIG. 2, the first binder precursor can preferably be applied to a nonwoven in a manner causing the binder to form an essentially continuous layer extending from a surface of nonwoven 2 into the nonwoven, and at least partially filling space between fibers of the nonwoven. The figure shows first binder 6 in a layer contacting the nonwoven and adjacent to a surface 18 of a reinforcing layer 16. Some discontinuity in the first binder precursor or in the binder layer may be acceptable and may result from entrapped air when the binder precursor is applied over the fibers of the nonwoven.

The binder precursor can be applied to the nonwoven principally to serve as an adhesive for abrasive particles which impart a desired abrasive character to the abrasive article. There are two main types of abrasive particles, inorganic abrasive particles and organic based particles. Inorganic abrasives particles can further be divided into hard inorganic abrasive particles (e.g., having a Moh hardness greater than 8) and soft inorganic abrasive particles (e.g., having a Moh hardness less than 8).

Examples of useful hard inorganic abrasive particles include fused aluminum oxide, heat treated aluminum oxide, white fused aluminum oxide, ceramic aluminum oxide materials such as those commercially available under the trade designation CUBITRON (available from Minnesota Mining and Manufacturing Company, St. Paul, Minn.), black silicon carbide, green silicon carbide, titanium diboride, boron carbide, tungsten carbide, titanium carbide, diamond, cubic boron nitride, garnet, fused alumina zirconia, sol gel abrasive particles and the like. Examples of sol gel abrasive particles can be found in U.S. Pat. Nos. 4,314,827; 4,623,364; 4,744,802; 4,770,671; and 4,881,951, all of which are incorporated herein by reference. It is also contemplated that the abrasive particles could comprise abrasive agglomerates such as those described in U.S. Pat. Nos. 4,652,275 and 4,799,939, the disclosures of which are incorporated herein by reference.

Examples of softer inorganic abrasive particles include silica, iron oxide, chromia, ceria, zirconia, titania, silicates and tin oxide. Still other examples of soft abrasive particles include metal carbonates (such as calcium carbonate (chalk, calcite, marl, travertine, marble and limestone), calcium magnesium carbonate, sodium carbonate, magnesium carbonate), silica (such as quartz, glass beads, glass bubbles and glass fibers) silicates (such as talc, clays, (montmorillonite) feldspar, mica, calcium silicate, calcium metasilicate, sodium aluminosilicate, sodium silicate) metal sulfates (such as calcium sulfate, barium sulfate, sodium sulfate, aluminum sodium sulfate, aluminum sulfate), gypsum, aluminum trihydrate, graphite, metal oxides (such as calcium oxide (lime), aluminum oxide, titanium dioxide) and metal sulfites (such as calcium sulfite), metal particles (tin, lead, copper and the like) glass particles, glass spheres, glass bubbles, flint, talc, emery, and the like.

Organic based particles include plastic abrasive particles formed from a thermoplastic material such as polycarbonate, polyetherimide, polyester, polyethylene, polysulfone, polystyrene, acrylonitrile-butadiene-styrene block copolymer, polypropylene, acetal polymers, polyvinyl chloride, polyurethanes, nylon and combinations thereof. Preferred thermoplastic polymers can be those possessing a high melting temperature and/or having good heat resistance properties. In the formation of thermoplastic particles, the polymer material may be formed into elongate segments (e.g., by extrusion) and cut into the desired length. Alternatively, thermoplastic polymer can be molded into a desired shape and particle size by, for example, compression molding or injection molding.

Organic abrasive particles can also comprise a crosslinked polymer such as those resulting from the polymerization of phenolics, aminoplasts, urethanes, epoxies, melamine-formaldehydes, acrylates, acrylated isocyanurates, urea-formaldehydes, isocyanurates, acrylated urethanes, acrylated epoxies, and mixtures thereof. These crosslinked polymers can be made, crushed, and screened to the appropriate particle size and particle size distribution.

The abrasive particles may contain a mixture of two or more different abrasive particles such as a mixture of hard inorganic abrasive particles and soft inorganic abrasive particles or a mixture of two hard or two soft abrasive particles. Individual abrasive particles of a mixture may either have similar average particle sizes, or may have different average particle sizes. In yet another aspect, there may be a mixture of inorganic abrasive particles and organic abrasive particles, which may have similar or different average sizes.

The abrasive particles may be present within the finished article at a weight ranging from 600 g/m$^2$ to 2,000 g/m$^2$, preferably at a weight of about 800 to 1200 g/m$^2$. Typical sizes for the particles (e.g., average particle diameter) may range from about 1 micrometer to about 10 millimeters.

The abrasive particles may be applied to a nonwoven having a binder precursor coated thereon by methods known in the abrasive art for application of such particles. The particles are preferably applied in a relatively uniform distribution across the surface of the binder precursor to provide a coating weight of at least about 600 g/m$^2$ abrasive particle. The abrasive particles can preferably be applied to the binder precursor by blowing, dropping, or electrostatically coating the particles onto the uncured binder precursor, or by using a combination of these.

The slurry layer includes a second binder and second abrasive particles. The slurry layer can preferably contact or at least be proximal to the binder layer and any abrasive particles protruding from the binder layer, and can at least partially fill space between fibers of the nonwoven. Referring again to FIG. 2, the figure shows an example of an abrasive article of the invention comprising slurry layer 10 contacting binder layer 4. Slurry layer 10 comprises second binder 12 and second abrasive particles 14.

The second binder can be chosen from any of the binders identified as useful for the binder layer described above (any of the first binder materials), and can be of the same composition as the first binder or different. This means that any of the general, specific, or preferred binders and binder precursors described above can also be useful within the slurry or slurry layer as the second binder or second binder precursor. Preferred materials for the second binder include materials containing an acrylic, a phenolic, an aminoplast having pendant α,β-unsaturated carbonyl group, a urethane, an epoxy, an ethylenically unsaturated material, an acrylated isocyanurate, a urea-formaldehyde, an isocyanurate, an acrylated urethane, an acrylated epoxy, a bismaleimide, an epoxy having fluorine substituent groups, and combinations thereof.

The second abrasive particles of the slurry layer can be any of the abrasive particles identified above, either generally, specifically, or as described to be preferred, and can be used in the slurry layer in combinations of particles as described with respect to their use in a binder layer. To provide a slurry layer that has similar abrasive properties as the binder layer (with its adhered first abrasive particles), it can be preferred that the second abrasive particles have similar abrasive properties as the first abrasive particles, e.g., as measured by standard testing methods relating to abrasive particles. This can mean that the abrasive particles have the same Moh's hardness or similar Moh's hardness (e.g., within one Moh's hardness value). This can also mean that the particles have the same or similar size, or that if a combination of particles is used the combinations are the same or similar. More preferably, at least some of the second abrasive particles of identical size and composition as the some of the first abrasive particles, and most preferably the second particles are of the same size and composition as the first abrasive particles.

The amount of abrasive particles included in the slurry layer can preferably be an amount of at least 20 parts by weight (pbw) abrasive particle per 80 parts by weight second binder, e.g., from about 20 to 80 pbw abrasive particle per 80 to 20 parts by weight second binder, with the range from about 60 to 80 pbw abrasive particles per 40 to 20 pbw second binder being particularly preferred.

The slurry can be applied to the article as a coatable liquid slurry comprising the second binder precursor and second abrasive particles. Suitable coating methods include methods known for applying coatable liquid or slurry materials, including spray coating, roll coating, dipping, etc. A preferred method of application is by spray coating the slurry. A spray coating method can preferably incorporate a spray nozzle coating tip that will be useful in the application of materials that contain abrasive particles. Preferred tips are hardened to prolong the life of the tip and its spray characteristics. Any such spray nozzle coating tip can be used, but preferred tips include internally atomizing spray tips, which are spray tips that cause atomization of the slurry inside of the tip. A suitable apparatus for this application is commercially sold as a #601 BINKS spray gun having a fluid nozzle (8% nickel, 151/VC 810) and a 59BSS fluid tip (0.223 in. (5.7 mm) orifice) available from ITW Industrial Finishing, Glendale Heights, Ill.

The slurry can be applied to the article in an amount useful to provide an abrasive article which will provide a combination of performance properties, including long wear, durability, and longevity, useful surface conditioning capabilities, etc. The slurry is preferably applied in an amount to provide a slurry layer having a coating weight in the range from about 200 to 800 grams per square meter, with preferred ranges being from about 400 to 600 grams per square meter (where the coating weight of the slurry layer includes the weight of the second binder, the second abrasive particles, and any other ingredients or additives).

After application of the first binder precursor and the slurry, the first and second binder precursors can be hardened, e.g., exposed to conditions that will cause hardening of the first and second binder precursors. Conditions that will cause hardening of a binder precursor will depend on the chemical composition of a binder precursor, and on the mechanism by which the particular binder precursor can be hardened. Thus, conditions chosen for use with any particular binder precursor or system or combination of binder precursors will depend greatly on the chemistry of the binder precursors. Hardening of many binder precursors can be achieved by known methods, including heating or irradiation (e.g., to harden a polymerizable or crosslinkable binder precursor), solvent removal (e.g., by evaporation or evolution, optionally including heating), or by cooling (e.g., to harden thermoplastic binder precursors). Details of useful methods and conditions for hardening a binder precursor will be appreciated and understood by those skilled in the arts of chemistry and binder materials, or in the production of abrasive products prepared from binders and binder precursors.

According to a preferred embodiment of the invention, the first binder precursor is preferably not exposed to conditions for hardening the first binder precursor until after the slurry is coated thereupon. That being said, it is understood that many chemical reactions, including reactions causing hardening of a binder precursor, can proceed at temperatures normally found in the manufacture (e.g., coating and other processing steps) of abrasive articles of the type described herein, even if such temperatures are not created to cause substantial and immediate hardening of a binder precursor, or even if the temperature is not associated with a step considered to be a hardening step. As a result, precursors can harden over a relatively long time without being exposed to conditions created to cause hardening, e.g., by being exposed to room temperature.

Preferred conditions for hardening a precursor include conditions that cause rapid hardening of the precursor, including exposure to elevated or reduced temperatures, or exposure to radiation. As a specific example of such conditions, a phenolic precursor can be hardened, e.g., cured, by exposure to elevated temperatures for a given amount of time. Preferred temperatures can be in the range from about 100° to 170° C., with the range from about 130° to 135° C. being particularly preferred for some phenolic precursors. The time of exposure to the elevated temperature can preferably be within the range from about 15 minutes to about 8 hours. Temperature and exposure time can be balanced to produce optimal results, including a sufficient degree of cure (provided by a sufficiently long exposure time) balanced with the avoidance of blistering or other negative effects (which may be caused by too high of a temperature). As an example of elevated temperature curing conditions, a phenolic precursor can be cured in two stages as follows: a first stage of 5–30 minutes at temperatures in the range of 255° F. to 315° F. (125° C. to 158° C.), followed by a second stage of 5–60 minutes at temperatures in the range of 255° F. to 315° F. (125° C. to 158° C.). Binder precursors of other chemistries can be hardened at temperatures and over times that will be understood by those familiar with curing such materials.

Typically, it can be preferred as a matter of efficiency to harden both the first and the second binder precursors in a single hardening step, i.e., by exposing both binder precursors to one set of conditions to cause hardening of both. This can be facilitated by appropriately choosing the chemistries of the first and second binder precursors, i.e., choosing similar chemistries or at least chemistries that can be hardened by exposure to the same or similar conditions. On the other hand, the invention also contemplates the use of first and second binder precursors that can be hardened by exposure to different conditions, by different chemical or physical mechanisms.

As illustrated in FIG. 2, a size coat 24 can be applied to the article over the slurry layer, normally contacting the slurry layer and the nonwoven (e.g., fibers not engulfed by the slurry layer). The size coat can be applied as a size coat precursor and hardened to form a hard yet flexible size coat. The size coat precursor can be applied to the article so that the size coat is preferably essentially continuous over the slurry layer, essentially sandwiching the slurry layer and the first binder and first abrasive particles between the reinforcing layer 16 and size coat 24. Some discontinuity in the size coat can be is acceptable and may result from entrapped air when a size coat precursor is applied over the fibers of the nonwoven. The size coat 24 can extend from the upper surface of the slurry layer through the nonwoven. Fibers of the nonwoven may extend above and below the size coat, and abrasive particles of the slurry layer are preferably substantially covered by the size coat, although portions of particles may optionally protrude above the outermost surface of the size coat.

The size coat and size coat precursor can be comprised of materials chosen from any of the materials identified above as useful for binders and binder precursors, and can be of the same composition as any of the prebond or the first or second binder or binder precursor, or different. These include materials that can be hardened to form a tough, flexible, rubbery, or elastomeric size coating, which in the form of a film preferably has physical properties including an elongation of less than 500%, preferably less than 200%, and a tensile strength of at least 1000 pounds per square inch (psi) (6890 kPa, 6.89 MPa), preferably at least 2000 psi (13780 kPa, 13.78 Mpa), as measured by ASTM D-412. Exemplary such materials include polyurethanes, polyureas, styrene-butadiene rubbers, nitrile rubbers, latex-modified phenolics, and polyisoprene. Preferred size coat materials include latex-modified phenolics, and particularly preferred size coat materials include polyurethanes prepared from the reaction of an isocyanate and a polyol.

The size coat precursor can be applied over the slurry layer before or after hardening of the slurry, and the size coat can then be hardened to provide a dry add-on of at least about 50 g/m$^2$, typically more than 100 g/m$^2$. The size coat precursor is preferably applied in a manner that will cause the size coat precursor to coat the slurry layer, and optionally to penetrate the nonwoven, to at least a partial extent, as allowed by the amount of other materials (binder and slurry layers) already contacting and filling in spaces of the nonwoven. When hardened, the size coat precursor preferably forms a size coat at the outermost or upper surface of the slurry layer, as shown in FIG. 2. A preferred method of application of the size coating precursor is by spray coating. The size coat precursor may then be exposed to conditions which will cause hardening of the size coat precursor.

The precursors of the prebond, first and second binders, and size coat may further contain other ingredients or additives as will be appreciated to a skilled artisan. These can include additional particles, abrasive particle surface modification additives, coupling agents, plasticizers, fillers, expanding agents, fibers, antistatic agents, initiators, suspending agents, photosensitizers, lubricants, wetting agents, surfactants, pigments, dyes, UV stabilizers, suspending agents and the like in amounts suitable to provide the properties desired. The selection of appropriate additives and the amounts thereof may readily be determined by those skilled in the art.

The addition of a suitable plasticizer can increase the erodability of the abrasive coating and soften the overall binder hardness. The plasticizer should be compatible with a binder precursor to avoid phase separation when the precursor is still in a coatable or liquid state. Examples of plasticizers include polyvinyl chloride, dibutyl phthalate, alkyl benzyl phthalate, polyvinyl acetate, polyvinyl alcohol, cellulose esters, phthalate, silicone oils, adipate and sebacate esters, polyols, polyol derivatives, t-butylphenyl diphenyl phosphate, tricresyl phosphate, castor oil, combinations thereof and the like.

A filler typically comprises a particulate material and generally has an average particle size range between 0.1 to 50 micrometers, typically between 1 to 30 micrometers. Examples of useful fillers include metal carbonates (such as calcium carbonate (chalk, calcite, marl, travertine, marble and limestone), calcium magnesium carbonate, sodium carbonate, magnesium carbonate), silica (such as quartz, glass beads, glass bubbles and glass fibers) silicates (such as talc, clays, (montmorillonite) feldspar, mica, calcium silicate, calcium metasilicate, sodium aluminosilicate, sodium silicate) metal sulfates (such as calcium sulfate, barium sulfate, sodium sulfate, aluminum sodium sulfate, aluminum sulfate), gypsum, vermiculite, wood flour, aluminum trihydrate, carbon black, metal oxides (such as calcium oxide (lime), aluminum oxide, tin oxide (e.g., stannic oxide), titanium dioxide) and metal sulfites (such as calcium sulfite), thermoplastic particles (polycarbonate, polyetherimide, polyester, polyethylene, polysulfone, polystyrene, acrylonitrile-butadiene-styrene block copolymer, polypropylene, acetal polymers, polyurethanes, nylon particles) and thermosetting particles (such as phenolic bubbles, phenolic beads, polyurethane foam particles and the like). The filler may also be a salt such as a halide salt. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metal fillers include, tin, lead, bismuth, cobalt, antimony, cadmium, iron titanium. Other miscellaneous fillers include sulfur, organic sulfur compounds, graphite, and metallic sulfides. It will be understood that the above fillers constitute a representative sampling and not a complete list of possible fillers for use herein.

Examples of antistatic agents include graphite, carbon black, vanadium oxide, conductive polymers, humectants, and the like. These antistatic agents are disclosed in U.S. Pat. Nos. 5,061,294; 5,137,542; and 5,203,884, incorporated herein by reference.

Any one or more of the precursors may further comprise a curing agent to initiate and complete any polymerization or crosslinking required in the conversion (i.e., hardening) of the precursor into a binder, coat, or prebond, etc. The term curing agent includes initiators, photoinitiators, catalysts and activators. The amount and type of the curing agent will depend largely on the chemistry of the binder precursor, as known by those skilled in the art.

The abrasive articles may be in sheet form or may be cut into circular discs, as illustrated in FIGS. 1 and 2. In another embodiment, an abrasive article can be constructed into an endless belt by splicing together the ends of a length of a material of the invention, in a known manner. Alternatively, sheets of the material may be stacked together with or without additional adhesive or binder to form a wheel or brush product, or, previously-cut discs may be ganged together with an adhesive or binder. A preferred abrasive article is a disc typically provided with a diameter ranging from about 2 centimeters (cm) to about 20 cm, which can be usefully employed with a right-angle power tool with a suitable attachment means. The inventive discs may be attached to such tools via a center arbor hole, pressure-sensitive adhesive means, or by the use of so-called "hook-and-loop" or another type of mechanical fastener.

The article can be further processed to provide finished articles suitable for use in surface finishing applications. For instance, the invention allows the formation of endless belts, discs, hand pads, and the like. Discs and hand pads can be prepared by cutting (e.g., die cutting) the articles to form appropriate shapes, in a known manner. In the formation of an endless belt, strips are cut having a length and a width suitable for the formation of endless belts that will fit on an abrasive belt sander, for example. Conventional splicing techniques may be used to form the finished belt. One such technique, known as a butt splice, generally requires that the ends of the composite strips be angled in a mating configuration, and the ends may then be spliced using a conventional urethane splicing adhesive and a heated belt splicing technique. Of course, other belt forming materials and techniques may be used, such as conventional coated abrasive belt manufacturing techniques and adhesives. The preparation of endless belts, discs, hand pads, and the like is within the skill of those practicing in the field, and the invention is not to be construed as limited to providing belts or the like that have been prepared by any specific preparative method.

In addition to the endless belts, discs and hand pads, abrasive wheels may be provided. In the formation of such wheels, the process is followed except that the reinforcing layer (e.g., numeral 16 of FIGS. 1 or 2) is not included in the article, and the article may be formed into wheels prior to hardening of the precursors. Annuli resembling the shape of the article 10 of FIG. 1 can be cut, and concentric stacks of dried but uncured annuli may be mounted onto a shaft. The number of annuli used in the formation of such wheels typically ranges from 2 to 10. The stacked annuli can be compressed to a suitable thickness (e.g., any thickness that meets end-user needs) and the binder precursors of the compressed stack of annuli can be hardened. Hardening of the precursors, at least where solvent evolution is involved, is typically and preferably carried out slowly to allow for the removal of solvent and to ensure sufficient hardening. For example, a stack of 5 or 6 annuli are typically cured in an oven for about 3 hours at 91° C. Thereafter, the oven temperature may be raised to 121° C. for an additional 5 hours. The compressed composite is allowed to cool to room temperature and is then removed from the shaft. A core material (e.g., polyurethane) may be cast into the internal diameter of the annulus. The resulting abrasive article is then dressed on a lathe to assure that the outer diameter of the finished wheel is concentric to the internal diameter.

EXAMPLES

Example 1 and Comparative Example A

Example 1

Example 1 describes a preferred embodiment of the invention. A 304 g/m$^2$ nonwoven was prepared from a blend of 75% 70 denier (77.8 dtex)×3.8 cm nylon staple fibers and 25% 12 denier (13.3 dtex)×5.1 cm nylon staple fibers using a RANDO WEBBER air lay machine (Rando Machine Corporation, Macedon, N.Y.). The resulting nonwoven was placed on a 16×16 woven nylon scrim cloth ("Style 6713531", Highland Industries, Inc., Greensboro, N.C.) and passed through a needle tacking machine (FIBERLOCKER, James Hunter Machine, North Adams, Mass.) fitted with needle board comprising 23 rows of 15×18×25×3.5 RB needles (Foster Needle Company, Manitowoc, Wis.) spaced 1.1 cm apart with adjacent needles within each row spaced 1.3 cm apart. The needle tacking machine was operated at 520 punches per minute, a penetration depth of 2.2 cm, and at a rate of 3.1 m/minute, such conditions being sufficient to result in a reinforced nonwoven having a composite structure comprising 60% of its thickness above the plane (top) defined by the nylon scrim cloth and about 40% below that plane (bottom). This composite was passed through a pair of opposing rollers (28 in.×10 in. O.D.) set at a pressure of about 0.45 kg/cm where the top roller is heated at 171° C. A prebond binder precursor consisting of 18.9% phenolic (a resole phenolic resin precursor comprising 70% solids condensate of a 1.5786:1.0 formaldehyde:phenol mixture with a 0.07% (on weight of phenol) sodium hydroxide catalyst), 62.4% acrylic latex (TYCRYL 2100, Reichold, Research Triangle Park, N.C.), 0.8% hydroxyethyl ethylene urea (Sartomer, Westchester, Pa.), 7.5% calcium carbonate, 10.1% water, and 0.3% pigment was applied to the nonwoven via a roll coater. The prebond binder was hardened by placing in an oven set at 135° C. for 10 minutes, resulting in a dry add-on of 420 grams/m$^2$. A first binder precursor consisting of 50.51% phenolic, 6.57% hydroxyethyl ethylene urea, 25.25% calcium carbonate, 12.63% of a 20% water solution of propylene glycol monoethyl ether (POLYSOLV, Ashland Chemical Inc., Columbus, OH), and 5.05% pigment was applied to the reinforced nonwoven via a roll coater to provide a dry add-on of 400 g/m$^2$. A blend of 10% ANSI grade 80 ceramic aluminum oxide particles (CUBITRON, Minnesota Mining and Manufacturing Company, St. Paul, Minn.) and 90% ANSI grade 80 alumina particles (trade designation FSX, Treibacher Schleifmittel North America, Inc., Niagra Falls, N.Y.), was then drop coated onto the first binder precursor. The mineral coated composite was than forwarded to a spray booth where a slurry consisting of 20.0% phenolic, 2.7% hydroxyethyl ethylene urea, 64.8% ANSI grade 80 alumina particles, 3.8% ANSI grade 80 ceramic aluminum oxide particles, 2.5% pigment and 6.1% solvent (20% water solution of POLYSOLV) was applied to achieve a dry add-on of 400 g/m$^2$. Following this combination of roll coating, mineral coating, and slurry spray coating steps, the applied binder precursors were hardened by heating at 125° C. for 30 minutes. An epoxy-modified polyurethane size coating consisting of 40.5% ketoxime-blocked urethane prepolymer (ADIPRENE BL-31, CK Witco, Greenwich, Conn.), 38.17% of a premix (consisting of 31.7% epoxy prepolymer (EPON 828, Shell Oil Company, Houston, Tex.), 28.3% isophorone diamine (Degussa-Huls Corporation, Ridgefield Park, N.J.), 40% propylene glycol monoethyl ether acetate (PM ACETATE, Arco Chemical Company, Houston, Tex.) and 21.32% propylene glycol monomethyl ether (POLYSOLV, Lyondell Chemical Company, South Charleston, W.Va.), was sprayed onto the abrasive coated nonwoven and hardened at 135° C. for 10 minutes to achieve a 120 g/m$^2$ dry add-on. The size-coated abrasive nonwoven was then converted into a 7 in. (17.8 cm) diameter disc for comparative evaluation.

Comparative Example A

Comparative Example A was prepared to demonstrate the effect of the inventive method used for Example 1. A 304 g/m$^2$ nonwoven was prepared from a blend of 75% 70 denier (77.8 dtex)×3.8 cm nylon staple fibers and 25% 12 denier (13.3 dtex)×5.1 cm nylon staple fibers using a RANDO WEBBER air lay machine (Rando Machine Corporation, Macedon, N.Y.). The resulting nonwoven was placed on a 16×16 woven nylon scrim cloth ("Style 6713531", Highland Industries, Inc., Greensboro, N.C.), and passed through a needle tacking machine (FIBERLOCKER, James Hunter Machine, North Adams, Mass.) fitted with needle board comprising 23 rows of 15×18×25×3.5 RB needles (Foster Needle Company, Manitowoc, Wis.) spaced 1.1 cm apart with adjacent needles within each row spaced 3.1 cm apart. The needle tacking machine was operated at 520 punches per minute, a penetration depth of 2.2 cm, and at a rate of 3.1 m/minute, such conditions being sufficient to result in a reinforced nonwoven having a composite structure comprising 60% of its thickness above the plane defined by the nylon scrim cloth and about 40% below that plane. This composite was passed through a pair of opposing rollers (28 in.×10 in. O.D.) set at a pressure of about 0.45 kg/cm where the top roller is heated at 171° C. A prebond binder precursor consisting of 18.9% phenolic (a resole phenolic resin precursor comprising 70% solids condensate of a 1.5786:1.0 formaldehyde:phenol mixture with a 0.07% (on weight of phenol) sodium hydroxide catalyst), 62.4% acrylic latex (TYCRYL 2100, Reichold, Research Triangle Park, N.C.), 0.8% hydroxyethyl ethylene urea (Sartomer, Westchester, Pa.), 7.5% calcium carbonate, 10.1% water and 0.3% pigment was applied to the nonwoven via a roll coater. The prebond binder was hardened by placing in an oven set at 135° C. for 10 minutes, resulting in a dry add-on of 420 g/m$^2$. A first binder precursor consisting of 52.61% phenolic, 6.84% hydroxyethyl ethylene urea, 26.30% calcium carbonate, 13.15% propylene glycol monomethyl ether (POLYSOLV, Lyondell Chemical Company, South Charleston, W.Va.), and 1.10% pigment was applied to the reinforced nonwoven via a roll coater to provide a dry add-on of 400 g/m$^2$. 800 g/m$^2$ of a blend of 10% ANSI grade 80 ceramic aluminum oxide particles (CUBITRON, Minnesota Mining and Manufacturing Company, St. Paul, Minn.) and 90% ANSI grade 80 alumina particles (trade designation FSX, Treibacher Schleifmittel North America, Inc., Niagra Falls, N.Y.), was then drop coated onto the first binder precursor. The mineral coated composite was than forwarded to a spray booth where an additional 400 g/m$^2$ of the first binder precursor (without abrasive particles) was applied. Following this combination of roll coating, mineral coating, and spray coating steps, the applied binder precursors were hardened by heating at 125° C. for 30 minutes. An epoxy-modified polyurethane size coating identical to that used in Example 1 was sprayed onto the abrasive coated nonwoven and hardened at 135° C. for 10 minutes to achieve a 120 g/m$^2$ dry add-on. The size-coated abrasive nonwoven was then converted into a 7 in. (17.8 cm) diameter disc for comparative evaluation.

Example 2 and Comparative Example B

Example 2 and Comparative Example B demonstrate the efficacy of the inventive method when applied to the manufacture of an abrasive article of finer abrasive grade.

Example 2

Example 2 was prepared identically to Example 1 with the exception that grade P100 alumina particles were substituted for ANSI grade 80 particles in both the drop coating step and in the slurry spray step.

Comparative Example B

Comparative Example B was prepared identically to Comparative Example C (below) with the exception that grade P100 alumina was used in the drop coating.

Example 3

Example 3 and Comparative Example C demonstrate the efficacy of the inventive method when applied to the manufacture of an abrasive article of yet finer abrasive grade than Example 2 and Comparative Example B.

Example 3 was prepared identically to Example 1 with the exception that grade P180 alumina particles were substituted for ANSI grade 80 particles in the drop coating step and in the slurry spray step.

Comparative Example C

Comparative Example C was prepared to demonstrate the effect of the inventive method used for Example 3. A 304 g/m$^2$ nonwoven was prepared from a blend of 75% 70 denier (77.8 dtex)×3.8 cm nylon staple fibers and 25% 12 denier (13.3 dtex)×5.1 cm nylon staple fibers using a RANDO WEBBER air lay machine (Rando Machine Corporation, Macedon, N.Y.). The resulting nonwoven was placed on a 16×16 woven nylon scrim cloth ("Style 6713531", Highland Industries, Inc., Greensboro, N.C.) and passed through a needle tacking machine (FIBERLOCKER, James Hunter Machine, North Adams, Mass.) fitted with needle board comprising 23 rows of 15×18×25×3.5 RB needles (Foster Needle Company, Manitowoc, Wis.) spaced 1.1 cm apart with adjacent needles within each row spaced 1.3 cm apart. The needle tacking machine was operated at 520 punches per minute, a penetration depth of 2.2 cm, and at a rate of 3.1 m/minute, such conditions being sufficient to result in a reinforced nonwoven having a composite structure comprising 60% of its thickness above the plane defined by the nylon scrim cloth and about 40% below that plane. This composite was passed through a pair of opposing rollers (28 in.×10 in. O.D.) set at a pressure of about 0.45 kg/cm where the top roller is heated at 171° C. A prebond binder precursor consisting of 18.9% phenolic (a resole phenolic resin precursor comprising 70% solids condensate of a 1.5786:1.0 formaldehyde:phenol mixture with a 0.07% (on weight of phenol) sodium hydroxide catalyst), 62.4% acrylic latex (TYCRYL 2100, Reichold, Research Triangle Park, N.C.), 0.8% hydroxyethyl ethylene urea (Sartomer, Westchester, Pa.), 7.5% calcium carbonate, 10.1% water and 0.3% pigment was applied to the nonwoven via a roll coater. The prebond binder was hardened by placing in an oven set at 135° C. for 10 minutes, resulting in a dry add-on of 420 g/m$^2$. A first binder precursor consisting of 56.8% phenolic, 7.4% hydroxyethyl ethylene urea, 29.3% calcium carbonate, and 6.5% propylene glycol monomethyl ether (POLYSOLV, Lyondell Chemical Company, South Charleston, W.Va.), was applied to the reinforced nonwoven via a roll coater to provide a dry add-on of 400 g/m$^2$. 1410 g/m$^2$ of a blend of 10% grade P180 ceramic aluminum oxide particles (CUBITRON, Minnesota Mining and Manufacturing Company, St. Paul, Minn.) and 90% grade P180 alumina particles (trade designation FSX, Treibacher Schleifmittel North America, Inc., Niagra Falls, N.Y.) was then drop coated onto the first binder precursor. The mineral coated composite was than forwarded to a spray booth where an additional 190-g/m$^2$ of the first binder precursor (without abrasive particles) was applied. Following this combination of roll coating, mineral coating, and spray coating steps, the applied binder precursors were hardened by heating at 125° C. for 30 minutes. An epoxy-modified polyurethane size coating identical to that used in Example 1 was sprayed onto the abrasive coated nonwoven and hardened at 135° C. for 10 minutes to achieve a 125 g/m$^2$ dry add-on. The size-coated abrasive nonwoven was then converted into a 7 in. (17.8 cm) diameter disc for comparative evaluation.

Test Method

The abrasive articles of the present invention were evaluated versus comparative examples using the test described below.

A tared carbon steel bar (4 inches×18 inches×½ inch) (5 cm×46 cm×1.25 cm) was secured to a workbench. A 7 in. (17.8 cm) diameter test specimen was mounted onto a right-angle compressed air tool (capable of rotating at 6000 rpm under zero load) via a 7 in. (17.8 cm) back-up pad (#917, Minnesota Mining and Manufacturing Company, St. Paul, Minn.). The compressed air tool was activated, tilted to cause the test specimen to be heeled about 7 degrees out of the plane defined by the bar's 4 in.×18 in. dimensions, and brought into abrasive contact with the bar by traversing the rotating test specimen along the bar's long dimension under no load other than that exerted by the weight of the tool itself (ca. 7 pounds (3.2 kg)). This abrasive action was maintained for 1 minute intervals for the life of each test specimen. The weight of the bar was recorded following each interval. The end point of the test was determined to be when a test specimen has been worn sufficiently to expose the reinforcing scrim cloth.

Test Results

The test results comparing the cut and life of Examples 1, 2, and 3, and Comparative Examples A, B, and C are shown in Table 1.

TABLE 1

| | Mass of material removed from test bar, grams | | | | | |
|---|---|---|---|---|---|---|
| Time (minutes) | Example 1 | Example 2 | Example 3 | Comp. Example A | Comp. Example B | Comp. Example C |
| 1 | 25.8 | 19.7 | 12.4 | 20.1 | 15 | 4.1 |
| 2 | 25 | 17.7 | 12.5 | 17.2 | 15 | 4.3 |
| 3 | 23 | 17.5 | 12.4 | 18.6 | 17.8 | 5 |
| 4 | 22.1 | 16.3 | 11.4 | 18 | 16.7 | 6.1 |
| 5 | 21.9 | 16.9 | 12.2 | 17.9 | 16.9 | 6.8 |
| 6 | 22.4 | 16.4 | 11.7 | 16.7 | 19.2 | |
| 7 | 18.4 | 15.7 | 10.8 | 19.9 | 19.7 | |
| 8 | 20.4 | 13.2 | 11.1 | 17 | | |
| 9 | 19.8 | 14.5 | 11.9 | 17 | | |
| 10 | 19.8 | 15.8 | 12.3 | 15.1 | | |
| 11 | 19 | 16.8 | 12 | | | |
| 12 | 17.1 | 14.3 | | | | |
| 13 | 16.4 | 15.2 | | | | |
| 14 | 20.8 | 14.1 | | | | |
| 15 | | 12.8 | | | | |
| 16 | | 12.7 | | | | |
| Total | 292 | 250 | 131 | 195 | 120 | 26 |

We claim:

1. A method for preparing an abrasive article, the method comprising the steps of:

applying a first binder precursor to a nonwoven;

applying first abrasive particles to the first binder precursor;

applying a slurry to the first binder precursor and first abrasive particles prior to hardening of the first binder precursor, the slurry comprising a second binder precursor and second abrasive particles, where the second abrasive particles have abrasive properties similar to those of the first abrasive particles; and after application of the slurry, exposing the first binder precursor and the second binder precursor to conditions to cause hardening of the first binder precursor and the second binder precursor.

2. The method of claim 1 wherein the conditions to cause hardening of the precursors include one or more of an elevated temperature, cooling, exposure to ultraviolet radiation, and mixtures thereof.

3. The method of claim 2 wherein the elevated temperature is a temperature of at least 100° C.

4. The method of claim 1 wherein the nonwoven comprises fibers comprise one or more of a polyester, a nylon, a polypropylene, an acrylic polymer, a rayon, a cellulose acetate polymer, a polyvinylidene chloride-vinyl chloride copolymer, a vinyl chloride-acrylonitrile copolymer, cotton, wool, jute, hemp, and combinations thereof.

5. The method of claim 1 wherein the nonwoven is prepared according to steps comprising:

forming a nonwoven; and bonding the fibers of the nonwoven at their mutual contact points with a prebond binder having a dried coating weight of about 200 grams per square meter to about 600 grams per square meter.

6. The method of claim 1 wherein the first binder precursor comprises one or more of a phenolic, an aminoplast having pendant α,β-unsaturated carbonyl group, a urethane, an epoxy, an ethylenically unsaturated material, an acrylated isocyanurate, a urea-formaldehyde, an isocyanurate, an acrylated urethane, an acrylated epoxy, a bismaleimide, an epoxy having fluorine substituent groups, and combinations thereof.

7. The method of claim 1 wherein the first abrasive particles are applied by drop coating.

8. The method of claim 1 wherein the slurry comprises:

from about 20 to 80 parts by weight second abrasive particles; and from about 80 to 20 parts by weight second binder precursor.

9. The method of claim 1 wherein the slurry comprises:

from about 60 to 80 parts by weight second abrasive particles; and from about 40 to 20 parts by weight second binder precursor.

10. The method of claim 1 wherein the second binder precursor comprises one or more of an acrylate, a phenolic, a polyurethane, a polyurea, a styrene-butadiene rubber, a nitrile rubber, a polyisoprene, and combinations thereof.

11. The method of claim 1 wherein one or both of the first and second abrasive particles comprises one or more of aluminum oxide, silicon carbide, alumina zirconia, diamond, ceria, cubic boron nitride, garnet, and combinations thereof.

12. The method of claim 11 wherein the aluminum oxide comprises one or more of ceramic aluminum oxide, heat-treated aluminum oxide, white-fused aluminum oxide and combinations thereof.

13. The method of claim 1 wherein the first binder precursor and the slurry at least partially fill spaces between the fibers of the nonwoven, which fibers extend through the first binder precursor and the slurry.

14. The method of claim 1 further comprising applying a size coat precursor to the slurry.

15. The method of claim 14 wherein the size coat precursor is applied to provide a dry add-on weight of at least 50 grams per square meter.

16. The method of claim 15 wherein the size coat precursor comprises one or more of polyurethanes, polyureas, styrene-butadiene rubbers, nitrile rubbers, latex-modified phenolics, and polyisoprene.

17. The method of claim 1 wherein prior to applying the first binder precursor, the method comprises affixing a reinforcing layer to a surface of the nonwoven.

18. The method of claim 17 wherein affixing is accomplished by needle-tacking, such that the fibers of the nonwoven extend through the reinforcing layer.

19. The method of claim 1 wherein second abrasive particles are of the same composition as first abrasive particles.

20. The method of claim 19 wherein second abrasive particles are of about the same size as first abrasive particles.

21. A method for the manufacture of an abrasive article, the method comprising steps of:

providing a nonwoven comprising fibers bonded to one another at their mutual contact points with a prebond binder having a dried coating weight of about 200 grams per square meter to about 600 grams per square meter, and having a first surface, a second major surface, and a middle portion extending therebetween;

applying a first binder precursor to the nonwoven in an amount sufficient to provide a dry coating weight of at least 200 grams per square meter, wherein the first binder precursor is selected from the group consisting of a phenolic, an aminoplast having pendant α,β-unsaturated carbonyl groups, a urethane, an epoxy, an ethylenically unsaturated material, an acrylated isocyanurate, a urea-formaldehyde, an isocyanurate, an acrylated urethane, an acrylated epoxy, a bismaleimide, an epoxy having fluorine substituent groups, and combinations thereof;

applying first abrasive particles to the first binder precursor at a coating weight of at least 600 grams per square meter;

applying a slurry to the first binder precursor and first abrasive particles prior to hardening of the first binder precursor in an amount sufficient to provide a dry add-on weight of at least 200 grams per square meter, the slurry comprising second abrasive particles having abrasive properties similar to those of the first abrasive particles, and a second binder precursor comprising one or more of a phenolic, a polyurethane, a polyurea, a styrene-butadiene rubber, a nitrile rubber, a polyisoprene, or a combination thereof; and after application of the slurry, exposing the first and second binder precursors to conditions to cause hardening of the first and second binder precursors.

22. An abrasive article comprising:

a nonwoven containing fibers;

a prebond binder which bonds the fibers at their mutual contact points, and having a dried coating weight of about 200 grams per square meter to about 600 grams per square meter;

a first binder layer contacting the prebond binder and at least partially filling space between the fibers of the nonwoven, wherein the first binder layer has a coating weight of at least 200 grams per square meter, and wherein the first binder layer has an outer surface;

first abrasive particles adhered to at least a portion of the outer surface of the first binder layer, wherein the first abrasive particles have a coating weight of at least 600 grams per square meter; and a slurry layer adhered to the outer surface of the first binder layer, the first abrasive particles, and fibers of the nonwoven web; wherein the slurry layer comprises a second binder and second abrasive particles, the second abrasive particles having abrasive properties similar to those of the first abrasive particles, wherein the slurry layer has a coating weight of at least 200 grams per square meter.

23. The article of claim 22 wherein both the first binder layer and the slurry layer substantially fill the space between the fibers of the nonwoven.

24. The article of claim 22 wherein fibers of the nonwoven comprise one or more of a polyester, a nylon, a polypropylene, an acrylic polymer, a rayon, a cellulose acetate polymer, a polyvinylidene chloride-vinyl chloride copolymer, a vinyl chloride-acrylonitrile copolymer, cotton, wool, jute, hemp, and combinations thereof.

25. The article of claim 22 wherein the prebond binder comprises one or more of a phenolic, a polyurethane, a polyurea, a styrene-butadiene rubber, a nitrite rubber, a polyisoprene, or a combination thereof.

26. The article of claim 22 wherein the first binder comprises one or more of a phenolic, an aminoplast having pendant α,β-unsaturated carbonyl group, a urethane, an epoxy, an ethylenically unsaturated material, an acrylated isocyanurate, a urea-formaldehyde, an isocyanurate, an acrylated urethane, an acrylated epoxy, a bismaleimide, an epoxy having fluorine substituent groups, and combinations thereof.

27. The article of claim 22 wherein the slurry layer comprises:

from about 20 to 60 parts by weight second binder; and from about 40 to 80 parts by weight second abrasive particles.

28. The article of claim 22 wherein the second binder comprises one or more of an acrylate, a phenolic, a polyurethane, a polyurea, a styrene-butadiene rubber, a nitrile rubber, a polyisoprene, and combinations thereof.

29. The article of claim 22 wherein one or both of the first and second abrasive particles comprises one or more of aluminum oxide, silicon carbide, alumina zirconia, diamond, ceria, cubic boron nitride, garnet, and combinations thereof.

30. The article of claim 29 wherein the aluminum oxide is selected from the group consisting of ceramic aluminum oxide, heat-treated aluminum oxide, white-fused aluminum oxide and combinations thereof.

31. The article of claim 22 further comprising a size coat proximal to the slurry layer.

32. The article of claim 22 wherein a reinforcing layer is needle-tacked to the nonwoven.

33. The article of claim 22 wherein second abrasive particles have about the same Moh's hardness as first abrasive particles.

34. The article of claim 22 wherein second abrasive particles are of the same composition as first abrasive particles.

35. The article of claim 22 wherein second abrasive particles are of about the same size as first abrasive particles.

36. The method of claim 1 wherein the nonwoven comprises fibers bonded at their mutual contact points with a prebond binder having a dried coating weight of about 200 grams per square meter to about 600 grams per square meter; the first binder precursor is applied to the nonwoven in an amount sufficient to provide a coating weight of at least 200 grams per square meter; the first abrasive particles are applied to the first binder precursor in an amount sufficient to provide a coating weight of at least 600 grams per square meter; and the slurry is applied to provide a slurry layer having a dry coating weight of at least 400 grams per square meter.

37. The method of claim 36 wherein the prebond binder has a dried coating weight of about 300 grams per square meter to about 600 grams per square meter; the first binder precursor is applied to the nonwoven in an amount sufficient to provide a coating weight of at least 400 grams per square meter; the first abrasive particles are applied to the first binder precursor in an amount sufficient to provide a coating weight of at least 800 grams per square meter; and the slurry is applied to provide a slurry layer having a dry coating weight of at least 400 grams per square meter.

38. The method of claim 37 wherein the first binder precursor is applied to the nonwoven in an amount sufficient to provide a coating weight of at least 400 grams per square meter; the first abrasive particles are applied to the first binder precursor in an amount sufficient to provide a coating weight of about 800 to about 1200 grams per square meter; and the slurry is applied to provide a slurry layer having a dry coating weight of about 400 to about 600 grams per square meter.

39. The method of claim 21 wherein the prebond binder has a dried coating weight of about 300 grams per square meter to about 600 grams per square meter; the first binder precursor is applied to the nonwoven in an amount sufficient to provide a coating weight of at least 400 grams per square meter; the first abrasive particles are applied to the first binder precursor in an amount sufficient to provide a coating weight of at least 800 grams per square meter; and the slurry is applied to provide a slurry layer having a dry coating weight of at least 400 grams per square meter.

40. The method of claim 39 wherein the first binder precursor is applied to the nonwoven in an amount sufficient to provide a coating weight of at least 400 grams per square meter; the first abrasive particles are applied to the first binder precursor in an amount sufficient to provide a coating weight of about 800 to about 1200 grams per square meter; and the slurry is applied to provide a slurry layer having a dry coating weight of about 400 to about 600 grams per square meter.

41. The article of claim 22 wherein the prebond binder has a dried coating weight of about 300 grams per square meter to about 600 grams per square meter; the first binder layer is applied to the nonwoven in an amount sufficient to provide a coating weight of at least 400 grams per square meter; the first abrasive particles are applied in an amount sufficient to provide a coating weight of at least 800 grams per square meter; and the slurry is applied to provide a slurry layer having a dry coating weight of at least 400 grams per square meter.

42. The article of claim 41 wherein the first binder layer is applied to the nonwoven in an amount sufficient to provide a coating weight of at least 400 grams per square meter; the first abrasive particles are applied in an amount sufficient to provide a coating weight of about 800 to about 1200 grams per square meter; and the slurry is applied to provide a slurry layer having a dry coating weight of about 400 to about 600 grams per square meter.

43. An abrasive article comprising:

a nonwoven web containing fibers;

a first binder layer contacting the nonwoven web and at least partially filling space between the fibers of the nonwoven, wherein the first binder layer has an outer surface;

first abrasive particles adhered to at least a portion of the outer surface of the first binder layer;

a slurry layer adhered to the outer surface of the first binder layer, the first abrasive particles, and fibers of the nonwoven web; wherein the slurry layer comprises a second binder and second abrasive particles, the second abrasive particles having abrasive properties similar to those of the first abrasive particles; and a size coating layer adjacent the slurry layer, wherein the size coating layer is substantially free of abrasive particles.

44. The article of claim 43 wherein a reinforcing layer is needle-tacked to the nonwoven.

45. The article of claim 44 wherein the nonwoven has a thickness ratio of about 60%.

46. The article of claim 43 wherein the nonwoven comprises fibers bonded at their mutual contact points with a prebond binder having a dried coating weight of about 200 grams per square meter to about 600 grams per square meter; the first binder layer is applied to the nonwoven in an amount sufficient to provide a coating weight of at least 200 grams per square meter; the first abrasive particles are applied to the first binder layer in an amount sufficient to provide a coating weight of at least 600 grams per square meter; and the slurry is applied to provide a slurry layer having a dry coating weight of at least 400 grams per square meter.

47. The article of claim 46 wherein the prebond binder has a dried coating weight of about 300 grams per square meter to about 600 grams per square meter; the first binder layer is applied to the nonwoven in an amount sufficient to provide a coating weight of at least 400 grams per square meter; the first abrasive particle are applied to the first binder layer in an amount sufficient to provide a coating weight of at least 800 grams per square meter; and the slurry is applied to provide a slurry layer having a dry coating weight of at least 400 grams per square meter.

48. The article of claim 47 wherein the first binder layer is applied to the nonwoven in an amount sufficient to provide a coating weight of at least 400 grams per square meter; the first abrasive particles are applied to the first binder layer in an amount sufficient to provide a coating, weight of about 800 to about 1200 Grams per square meter; and the slurry is applied to provide a slurry layer having a dry coating weight of about 400 to about 600 grams per square motor.

* * * * *

UNITED STATES PATENT AND TRADEMARK OFFICE

CERTIFICATE OF CORRECTION

PATENT NO. : 6,352,567 B1
DATED : March 5, 2002
INVENTOR(S) : Windisch, Laurie A.

It is certified that error appears in the above-identified patent and that said Letters Patent is hereby corrected as shown below:

Column 3,
Line 40, “those that that are”, should read -- those that are --.

Signed and Sealed this

Fourteenth Day of January, 2003

JAMES E. ROGAN
*Director of the United States Patent and Trademark Office*